US010138044B2

(12) United States Patent
Liao et al.

(10) Patent No.: US 10,138,044 B2
(45) Date of Patent: Nov. 27, 2018

(54) AIRTIGHT SHEATH FOR PACKING A BOTTLE

(71) Applicants: Tai-An Liao, Taipei (TW); Kao-Hsiung Liao, Taipei (TW)

(72) Inventors: Tai-An Liao, Taipei (TW); Kao-Hsiung Liao, Taipei (TW)

( * ) Notice: Subject to any disclaimer, the term of this patent is extended or adjusted under 35 U.S.C. 154(b) by 0 days.

(21) Appl. No.: 15/464,367

(22) Filed: Mar. 21, 2017

(65) Prior Publication Data

US 2018/0273272 A1 Sep. 27, 2018

(51) Int. Cl.
*B65D 81/03* (2006.01)

(52) U.S. Cl.
CPC ..... *B65D 81/03* (2013.01)

(58) Field of Classification Search
CPC ..... B65D 30/00; B65D 81/00; B65D 81/02; B65D 81/03; B65D 81/05; B65D 81/051; B65D 81/052; B65D 81/053
USPC ..... 206/522; 383/3
See application file for complete search history.

(56) References Cited

U.S. PATENT DOCUMENTS 7,066,331 B2 * 6/2006 Koyanagi ..... B65D 81/052 206/522
7,726,484 B2 * 6/2010 Komatsu ..... B65D 81/052 206/522
7,757,854 B2 * 7/2010 Morris ..... B65D 81/03 206/522
8,770,840 B2 * 7/2014 Liao ..... B65D 81/03 206/522
9,428,315 B2 * 8/2016 Liao ..... B65D 81/052
9,731,885 B2 * 8/2017 Liao ..... B65D 81/052
2007/0131575 A1 * 6/2007 Abe ..... B65D 81/052 206/522
2008/0193055 A1 * 8/2008 Chen ..... B65D 81/03 383/3
2009/0169134 A1 * 7/2009 Hsu ..... B65D 81/052 383/3

FOREIGN PATENT DOCUMENTS

JP 11342980 A * 12/1999 ..... B65D 85/30
JP 2000-7036 A * 1/2000 ..... B65D 81/30

* cited by examiner

*Primary Examiner* — Bryon Gehman

(57) ABSTRACT

An airtight sheath for packing a bottle, the airtight sheath includes a first buffering unit, a second buffering unit, a bottom unit, and a cover. The first buffering unit includes two distal heat-sealing sides being heat-sealed to terminate two opposite sides of the first buffering unit. Two opposite sides of the second buffering unit are heat-sealed with the two distal heat-sealing sides. The bottom unit and the first and second buffering units cooperatively form a packing space for packing the bottle therein. The cover includes connecting air columns and at least a lid air column, and a side of each of the connecting air columns opposite to the lid air column is heat-sealed with the first buffering unit. The cover and the first buffering unit cooperatively form an insertion slot communicating with the packing space for enveloping a neck portion of the bottle.

10 Claims, 8 Drawing Sheets

AIRTIGHT SHEATH FOR PACKING A BOTTLE

BACKGROUND OF THE INVENTION

1. Field of the Invention

The present invention relates to a buffering sheath, and more particularly to an airtight sheath for packing and protecting bottles from being damaged by external impact.

2. Related Art

A traditional wrapping material is generally provided with a soft inner pad, such as foam, on a peripheral side thereof for protecting articles to be wrapped so as to prevent the articles from being damaged or broken by external vibration. However, the soft inner pad is required to be attached to the wrapping material with additional processes to avoid moving or coming off from the wrapping material, but the additional processes of attaching the soft inner pad are not only cumbersome but also costly to assembly.

In view of the above-mentioned drawbacks, an air inflatable structure is designed to resist impact, with air columns filled with air, and is capable of protecting articles from being vibrated. Due to the great utility, the inflatable air packing materials are to replace traditional wrapping materials by degrees, especially in the field of packing high-tech products, for example, such as mobile phones or display panels. Recently, air packing materials are also utilized to wrap fragile articles made of glass or porcelain, such as wine bottles, in a way that a bottle is surrounded by several air packing pads in a container. Specifically, a bottle is placed on an air packing pad and enveloped by separate air packing pads. Though the bottle can be protected by the air packing pads, the bottle is not well positioned because the air packing pads are separately placed. In other words, separate pieces of packing pads are likely to move in the container whereby rendering the bottle fragile to impact. Besides, it is difficult to hold separately placed air packing pads together with the bottle, or to take out the bottle together with separate air packing pads from the container. As a result, traditional air packing pads fail to provide well protection for bottles while bottles are taken out of the container, or while bottles are loaded in the container.

Consequently, it is imperative to improve an inflation structure to be capable of securely positioning fragile bottles and effectively protecting bottles from being impacted by external force.

SUMMARY OF THE INVENTION

Accordingly, an objective of the present invention is to provide an airtight sheath for packing a bottle which is capable of being buffered against external impact.

Another objective of the present invention is to provide an airtight sheath capable of protecting a neck portion of a bottle.

To achieve the above-mentioned objectives, the airtight sheath is made of at least two outer films and comprises a first buffering unit comprising a plurality of first air columns, and two distal heat-sealing sides being heat-sealed to terminate two opposite sides of the first buffering unit; a second buffering unit comprising a plurality of second air columns, two opposite sides of the second buffering unit being heat-sealed with the two distal heat-sealing sides of the first buffering unit; a bottom unit comprising a plurality of bottom air columns connected with ends of the plurality of first air columns and second air columns, the bottom unit and the first and second buffering units cooperatively forming a packing space for packing the bottle therein; and a cover extending from one end of the first buffering unit opposite to the bottom unit and disposed in the packing space, the cover comprising two connecting air columns and at least a lid air column located between the two connecting air columns, each of the connecting air columns and the lid air column respectively having a top portion and a shielding portion bending from the top portion and extending downward to the packing space, the top portion extending and bending from the first air column, a side of each of the connecting air columns opposite to the lid air column being heat-sealed with the first buffering unit, whereby the cover and the first buffering unit cooperatively forming an insertion slot communicating with the packing space for enveloping a neck portion of the bottle.

In one aspect of the present invention, the first buffering unit is provided with multiple bending nodes formed on at least several of the first air columns corresponding in position to the shielding portions of the cover, and the bending nodes are arranged in parallel and in alignment with each other and heat-sealed to allow the first air columns to be bendable with respect to the bending nodes.

In another aspect of the present invention, the cover further comprises two protection units, which are heat-sealed to the connecting air columns in such a way that the connecting air columns and the lid air column are located between the two protection units, each of the protection units comprises a plurality of divided air columns and protection air columns extending in the packing space, the divided air columns extend and bend from the first air columns, each of the divided air columns has a width smaller than that of each of the first air columns, and an interval heat-sealing line is provided between and along either two of the divided air columns for facilitating bending of the divided air columns.

In another aspect of the present invention, the bottom air columns of the bottom unit integrally extend and bend from the first air columns and the second air columns, and two recessed sealing lines respectively formed at and bending inwardly from opposite end portions of the bottom unit and connecting the distal heat-sealing sides of the first buffering unit so as to form two recessed portions between the bottom unit and the first and second buffering units.

The airtight sheath of the present invention is to utilize air inflation structure to buffer the bottle therein against external impact from either bottom, up, or side directions, and the bottle is securely packed in the packing space as well as the neck portion enveloped by the cover. As a result, the airtight sheath efficiently provides multidimensional protection for the bottle 5 during package and delivery from being damaged by external impact.

DESCRIPTION OF THE PREFERRED EMBODIMENTS

An airtight sheath of the present invention is capable of being quickly inflated with air to function as an impact resistant structure, where an inner space of the airtight sheath is capable of packing a bottle so as to provide impact resistance for the bottle, which is, for example, a wine bottle, but is not limited thereby.

Figure 1:
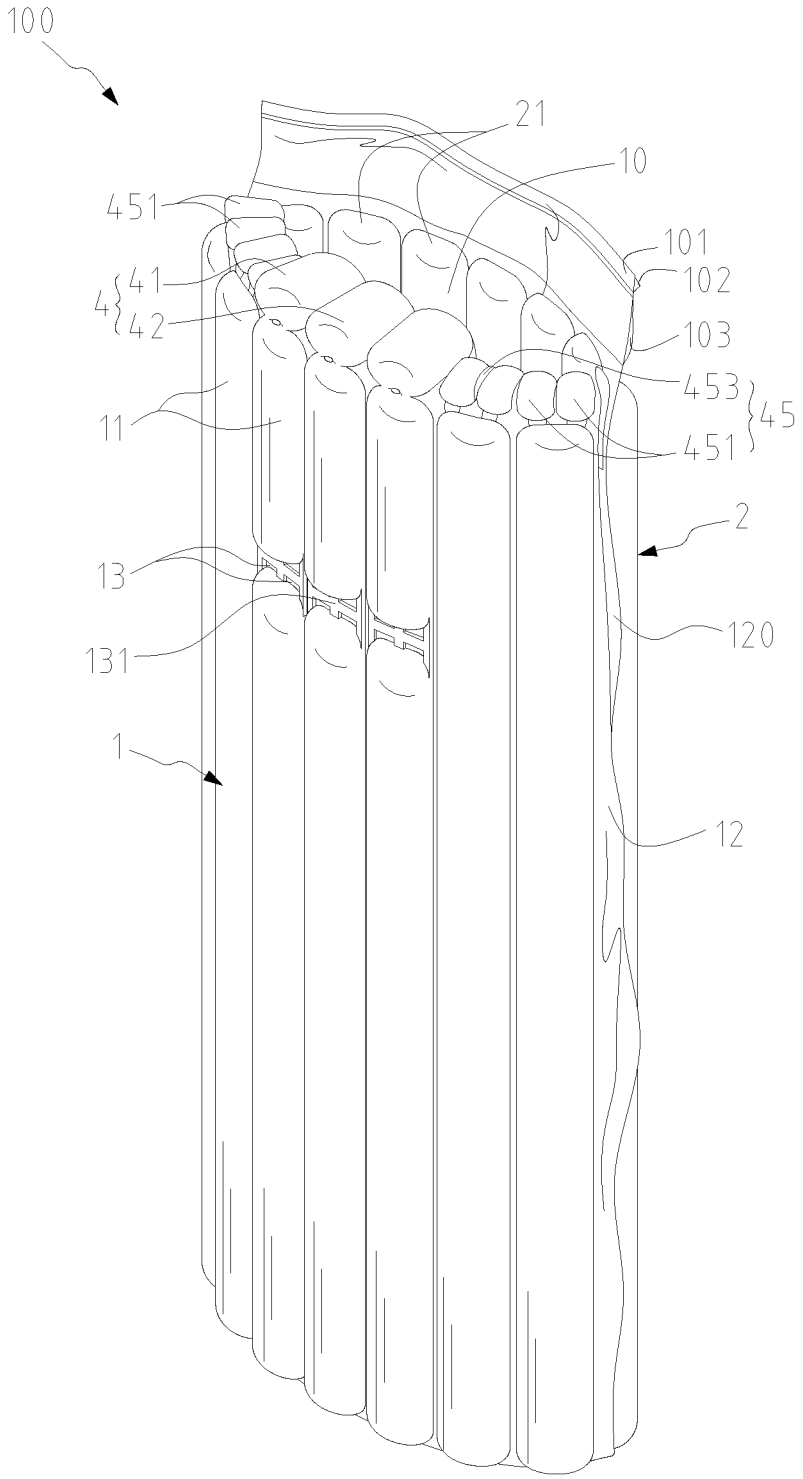
FIG. 1 is a schematic perspective view of an airtight sheath for packing a bottle of the present invention.
Figure 2:
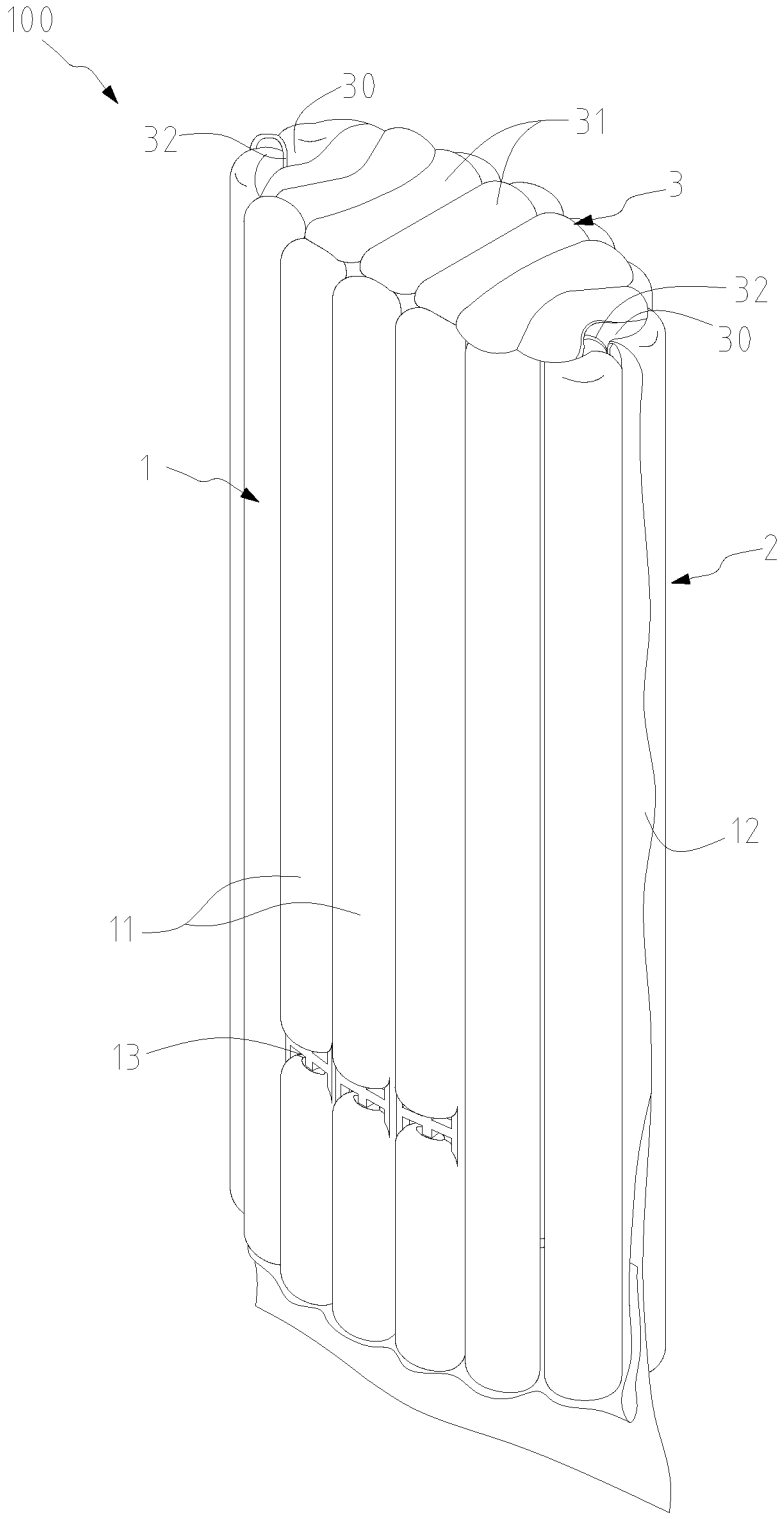
FIG. 2 is a front bottom perspective view of the airtight sheath of the present invention.
Figure 3:
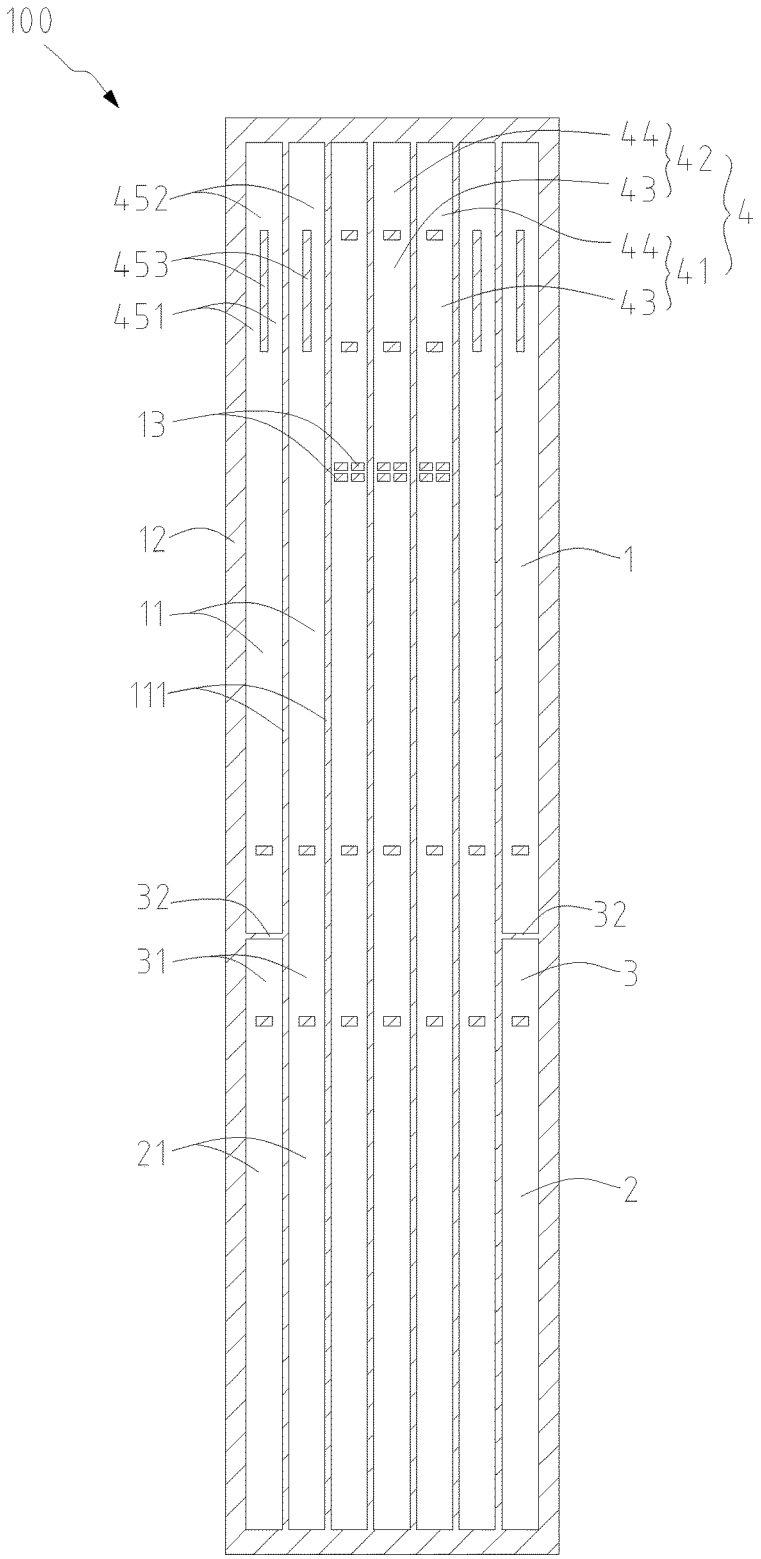
FIG. 3 is a schematic expanded view of FIG. 1.

Please refer to FIG. 1 showing a schematic perspective view of an airtight sheath for packing a bottle of the present invention. The airtight sheath 100 is made of two outer films 101, 102 being heat-sealed together, and the airtight sheath 100 comprises a first buffering unit 1, a second buffering unit 2, a bottom unit 3, and a cover 4. The first buffering unit 1 comprises a plurality of first air columns 11 extending longitudinally and arranged in parallel. Either two of the first air columns 11 are spaced with an interval heat-sealing line 111 for heat-sealing the two outer films 101, 102. Peripheral sides of the first buffering unit 1 are heat-sealed as well, wherein two distal heat-sealing sides 12 are heat-sealed to terminate two opposite longitudinal sides of the first buffering unit 1.

The second buffering unit 2 comprises a plurality of second air columns 21 extending longitudinally and arranged in parallel. Likewise, either two of the second air columns 21 are spaced with an interval heat-sealing line 211. Peripheral sides of the second buffering unit 2 are heat-sealed, wherein two opposite sides of the second buffering unit 2 are heat-sealed with the two distal heat-sealing sides 12 of the first buffering unit 1 so as to connect the first and second buffering units 1 and 2. In this embodiment, the second buffering unit 2 is of a same size and profile as the first buffering unit 1. The two outer films 101, 102 extend upward of the second buffering unit 2 to form an inflation path 103, which is traversely located above the second air columns 21 for enabling air flow over the inflation path 103 to inflate the entire airtight sheath 100.

Figure 4:
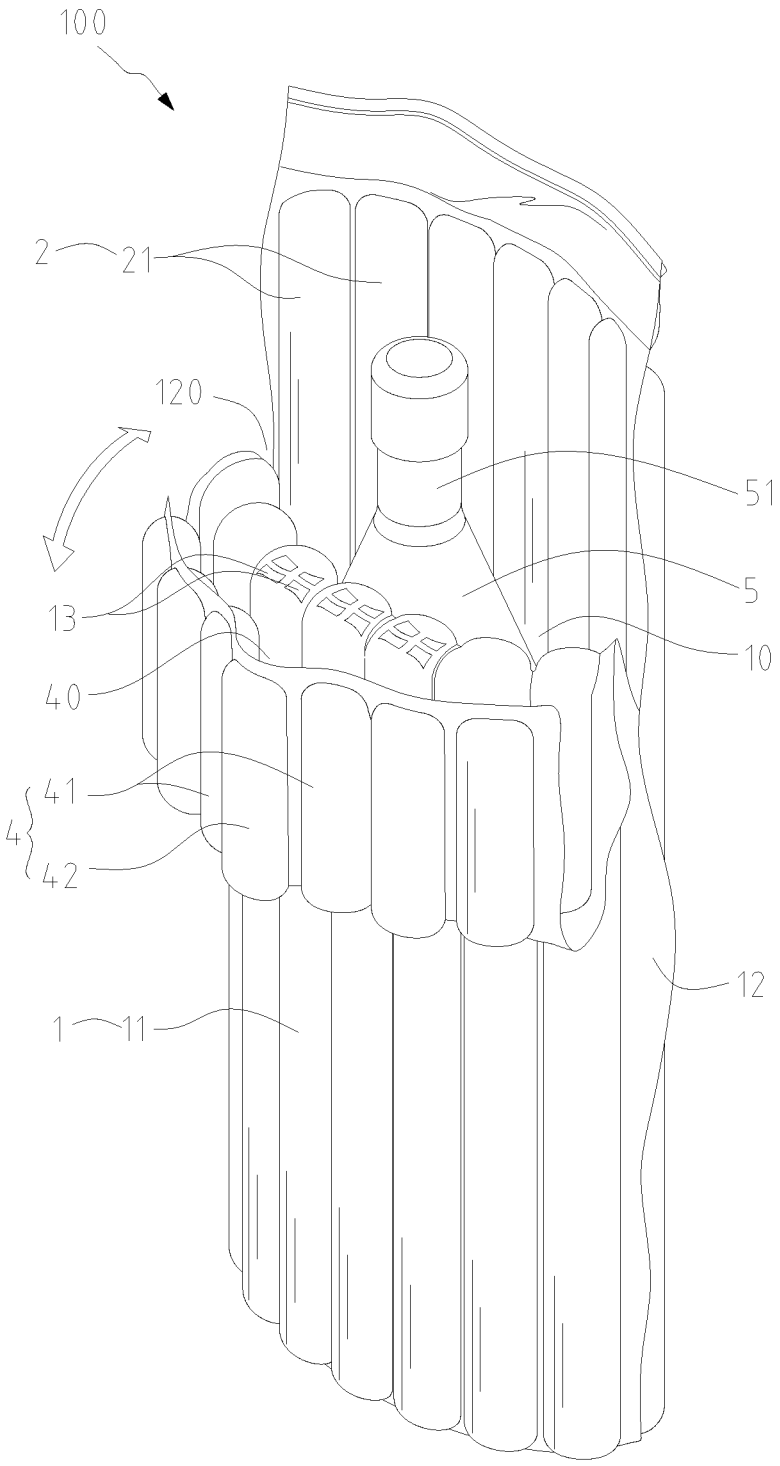
FIG. 4 is a perspective view showing a cover of the airtight sheath is open and a bottle is in the airtight sheath.

The bottom unit 3 comprises a plurality of bottom air columns 31 integrally extend and bend from ends of the first air columns 11 and the second air columns 21, whereby a packing space 10 is formed by the first and second buffering units 1 and 2 and the bottom unit 3 and is open at a top of the sheath 100 for packing a bottle 5 therein (as shown in FIG. 4). When inflating the airtight sheath 100, air is to flow from the inflation path 103 to the second air columns 21, the bottom air columns 31, and the first air columns 11. It is noted that two recessed sealing lines 32 are respectively formed at and bend inwardly from opposite end portions of the bottom unit 3. The two recessed sealing lines 32 connect the distal heat-sealing sides 12 of the first buffering unit 1 so as to form two recessed portions 30 between the bottom unit 3 and the first and second buffering units 1 and 3. The recessed portions 30 ensure that the bottom air columns 31 are not extending out of the bottom unit 3 and therefore the airtight sheath 100 is capable of being stably placed.

Figure 5:
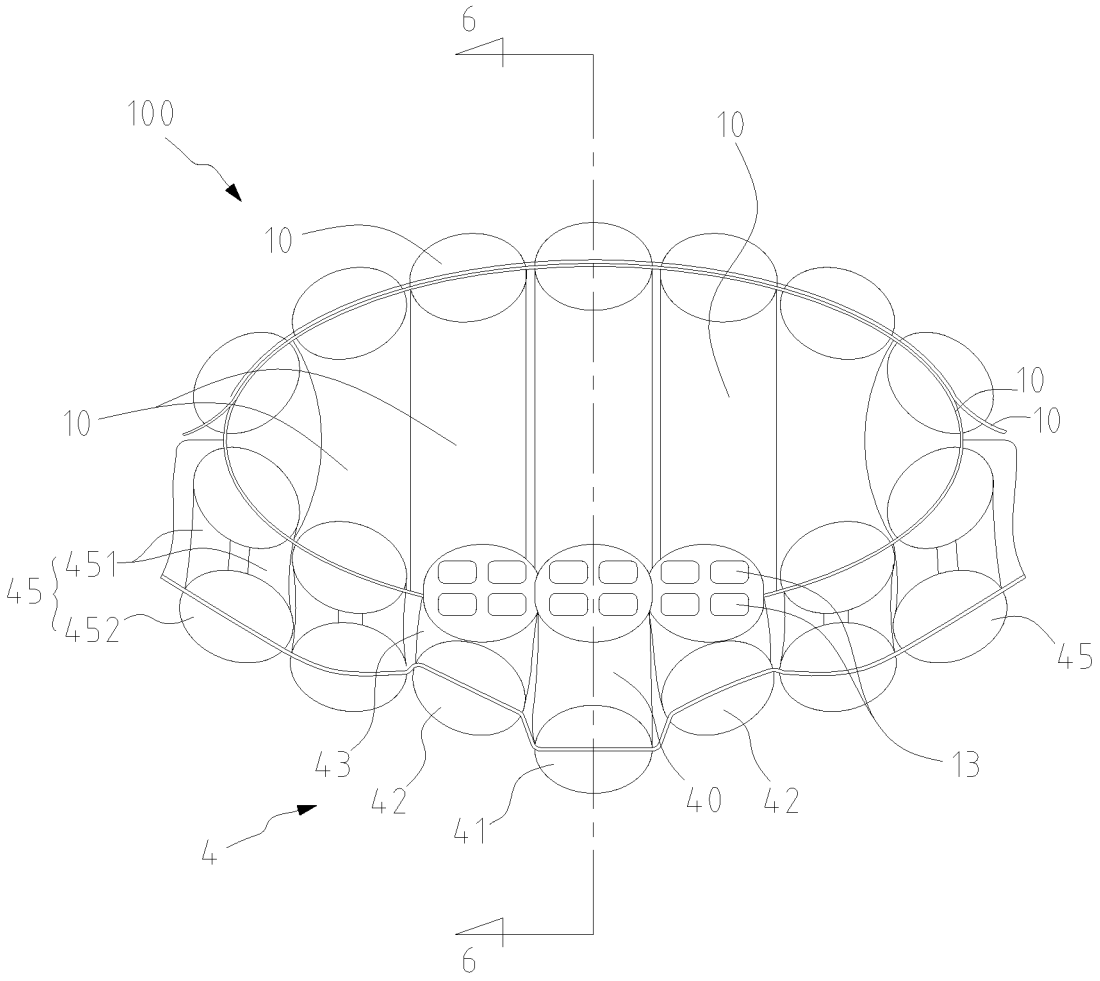
FIG. 5 is a top plan view of FIG. 4.

Referring to FIGS. 1 and 4, the cover 4 extends from one end of the first buffering unit 1 opposite to the bottom unit 3 and is disposed in the packing space 10. The cover 4 comprises two connecting air columns 41 and a lid air column 42 located between the connecting air columns 41 in such a way that two opposite sides of the lid air column 42 are respectively heat-sealed to the connecting air columns 41. Each of the connecting air columns 41 and the lid air column 42 respectively has a top portion 43 and a shielding portion 44 bending from the top portion 43 and extending downward to the packing space 10. The shielding portion 44 has a length larger than that of the top portion 43, but smaller than that of the first air column 11. The top portions 43 extend and bend from ends of three of the first air columns 11 which are centrally located with respect to the first buffering unit 1. A side of each of the connecting air columns 41 opposite to the lid air column 42 is heat-sealed to the interval heat-sealing line 111 of the first air column 11, whereby the connecting air columns 41 and the lid air column 42 jointly form a substantially U-like shape as shown in FIGS. 4 and 5. In this manner, the cover 4 and the first buffering unit 1 cooperatively form an insertion slot 40 (as shown in FIG. 4) communicating with the packing space 10 for enveloping a neck portion 51 of the bottle 5.

Figure 6:
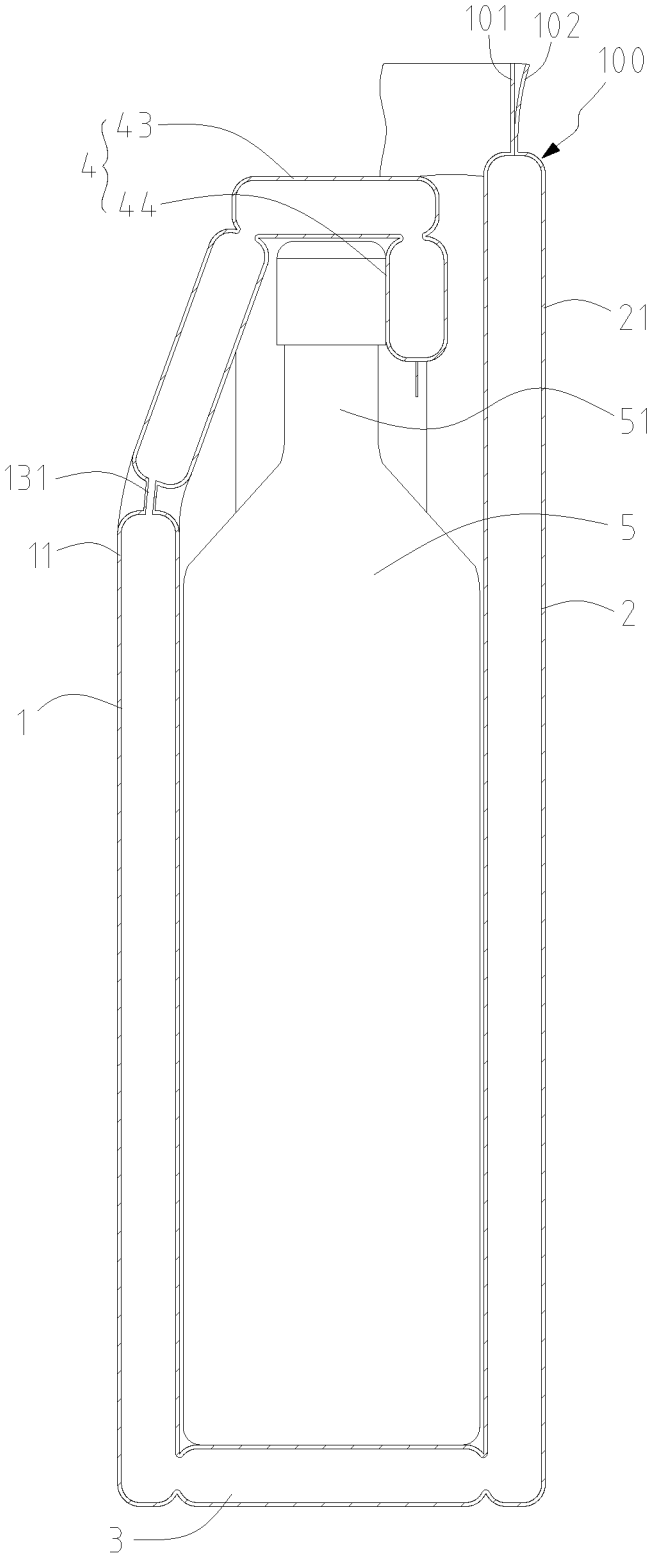
FIG. 6 is a schematic cross-sectional view taken along line 6-6 of FIG. 5 of the present invention.

Referring to FIGS. 1 and 4, the distal heat-sealing sides 12 respectively extend upward to a location lower than the cover 4, whereby forming gaps 120 between the distal heat-sealing sides 12 and the top of the airtight sheath 100 such that the gaps 120 are open upward to the outside. The gaps 120 on two opposite sides of the airtight sheath 100 are configured to allow the first buffering unit 1 or the second buffering unit 2 to be bendable with respect to the gaps 120, so that the bottle 5 is capable of being easily put in or take out of the packing space 10. Further referring to FIG. 1 and FIG. 6, the second air columns 21 extend upward to a height corresponding to the cover 4 for providing side protection for the neck portion 51.

Referring to FIG. 1 in combination with FIGS. 4 and 5, in this embodiment, the first buffering unit 1 is further provided with multiple bending nodes 13 formed on the three of the first air columns 11 in a position lower than the shielding portions 44 of the cover 4. It is noted that the other first air columns 11 are not provided with the bending nodes 13 in order to ensure that the first buffering unit 1 can remain straight. The bending nodes 13 are arranged in parallel and in alignment with each other and are being heat-sealed. Specifically, four bending nodes 13 are spaced apart from each other and arranged in a rectangular shape on each of the three of the first air columns 11 in such a way that a cross-like portion 131 is formed by the four bending nodes 13 so as to allow air to flow through the cross-like portion 131 and to inflate the cover 4 quickly. The bending nodes 13 are configured to facilitate bending of the first air columns 11 with respect to the bending nodes 13, so as to enable the cover 4 to be pulled outward in conjunction with bending of the first air columns 11.

Referring to FIG. 1, the cover 4 further comprises two protection units 45, which are heat-sealed to the connecting air columns 41 in such a way that the connecting air columns 41 and the lid air column 42 are located between the two protection units 45. Each of the protection units 45 comprises a plurality of divided air columns 451 and protection air columns 452 extending in the packing space 10. The divided air columns 451 extend and bend from the first air columns 11, wherein each divided air column 451 has a width smaller than that of the first air column 11. In this embodiment, two divided air columns 451 are defined as a set, which is in alignment with the corresponding first air column 11 and the protection air column 452 down below. An interval heat-sealing line 453 is provided between and along either two of the adjacent divided air columns 451 for facilitating bending of the divided air columns 451 in a longitudinal direction, so that the protection units 45 are to bend inward of the packing space 10 to further provide side protection for the top of the airtight sheath 100 (as shown in FIG. 1).

As shown in FIG. 4, the bottle 5 is placed in the packing space 10 of the airtight sheath 100, and is well protected by the first air columns 11, the second air columns 21, and the bottom air columns 31. As shown in FIG. 5, the insertion slot 40 of the cover 4 of is bendable to cover the neck portion 51 of the bottle 5, with the connecting air columns 41, the lid air column 42, and the first air columns 11 enveloping the neck portion 51. In this manner, the bottle 5 is securely packed in the packing space 10 and is well protected by the airtight sheath 100 from being impacted from bottom, up, or side directions. Likewise, when the bottle is to be taken out of the airtight sheath 100, the cover 4 is capable of bending outward of the packing space 10 in conjunction with bending of the first buffering unit 1 with respect to the bending nodes 13.

Figure 7:
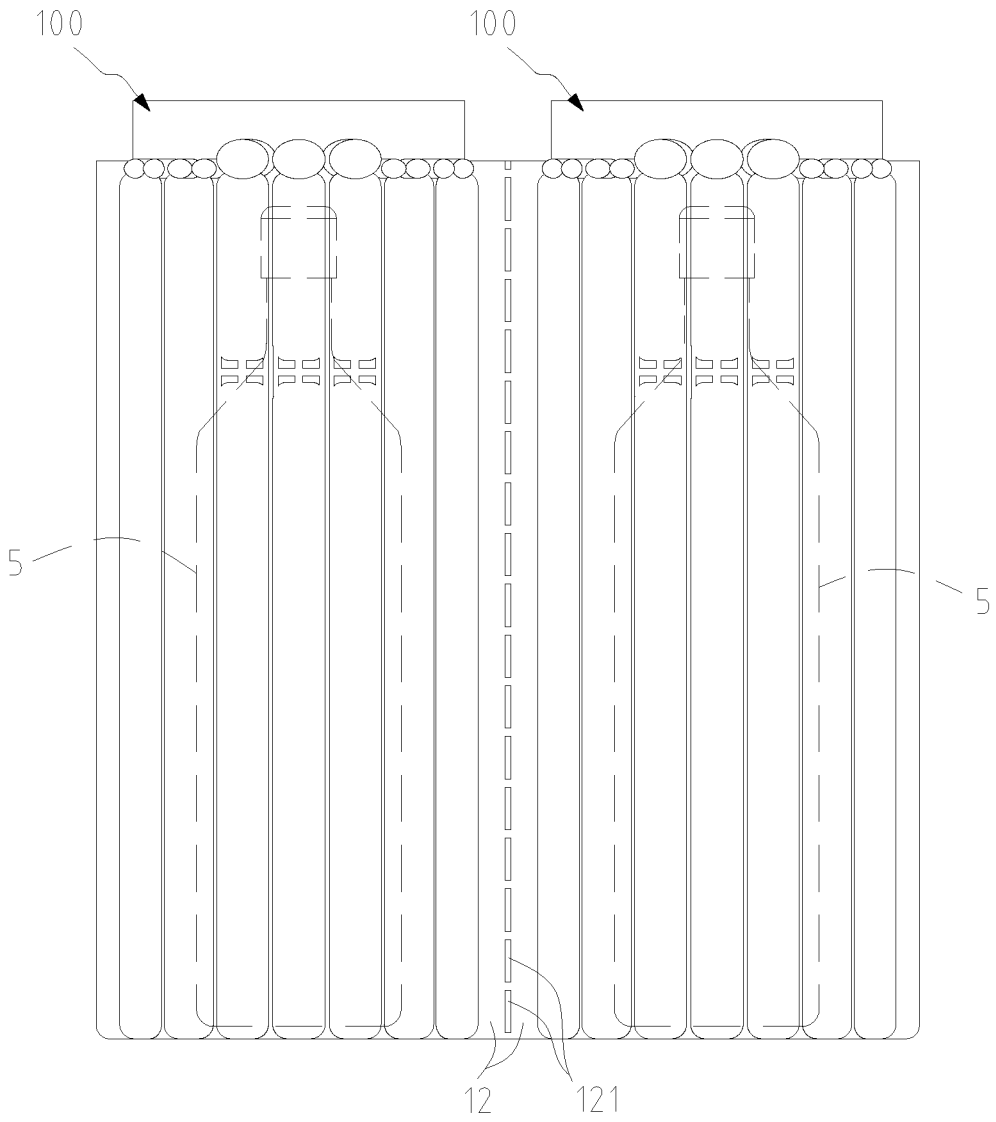
FIG. 7 is a schematic front elevational view showing two airtight sheaths of the present invention are connected together.

Referring to FIG. 7 showing another embodiment of the airtight sheath 100 of the present invention, in this embodiment, two airtight sheaths 100 are capable of being connected side by side as a whole for packing two bottles 5. Specifically, two adjacent distal heat-sealing sides 12 of the two airtight sheaths 100 are heat-sealed, where the two adjacent distal heat-sealing sides 12 are further provided with a plurality of breakable sections 121 formed thereon and vertically arranged and spaced apart from each other, so that the two airtight sheaths 100 are separable by tearing the breakable sections 121. The two or more connected airtight sheaths 100 are easy to be carried with two or more bottles 5 in the airtight sheaths 100.

Figure 8:
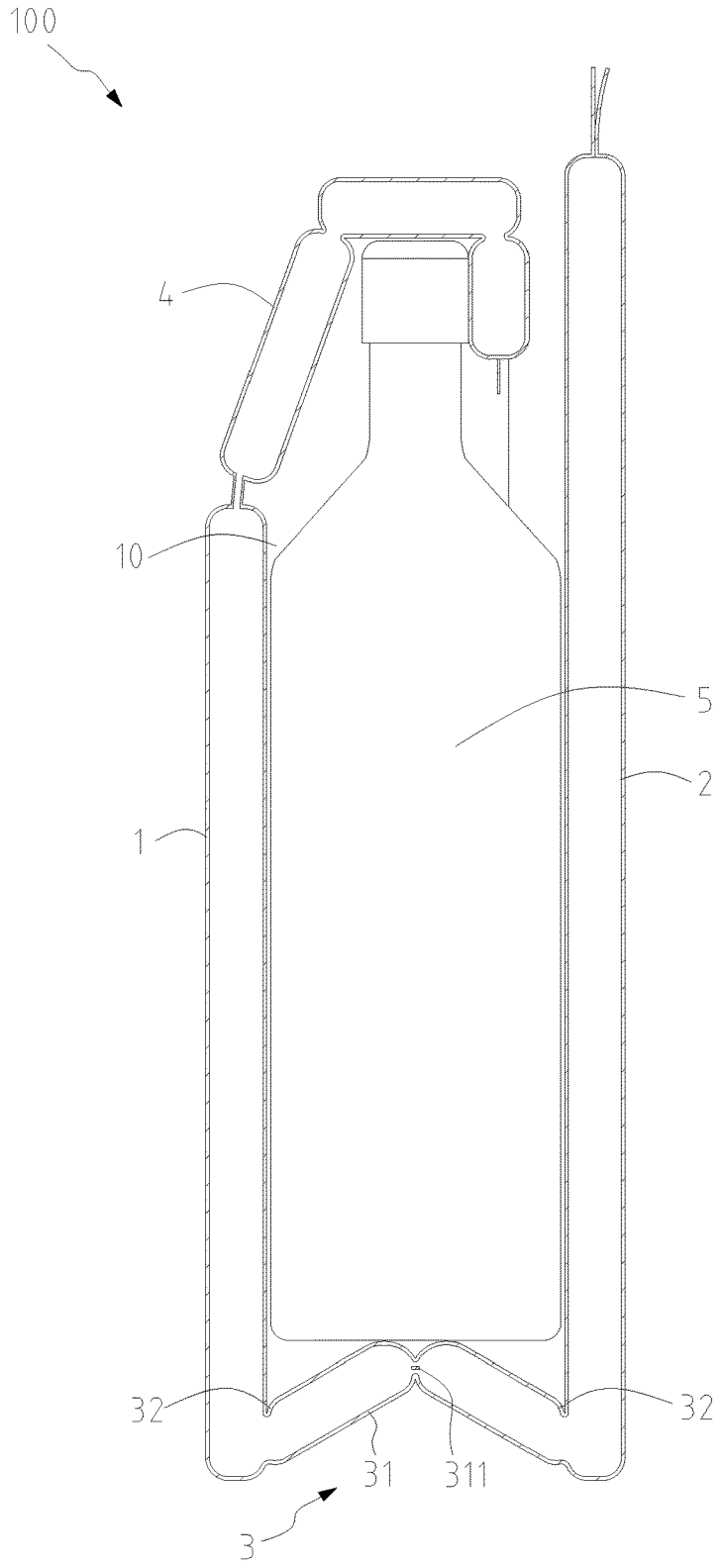
FIG. 8 is a schematic cross-sectional view of an airtight sheath in accordance with another embodiment of the present invention.

Referring to FIG. 8 showing another embodiment of the airtight sheath 100 of the present invention, each of the bottom air columns 31 has at least a sealing node 311 being heat-sealed. The sealing nodes 311 are in alignment with each other at middle portions of the bottom air columns 31 and are provided cooperatively with the recessed sealing lines 32 to enable the bottom air columns 31 to bend toward the packing space 10 when being inflated, such that the bottom unit 3 functions as a reversed hammock-like cushioning structure for supporting the bottle 5.

Accordingly, the airtight sheath 100 of the present invention is to utilize air inflation structure to buffer the bottle 5 therein against external impact from either bottom, up, or side directions, and the bottle 5 is securely packed in the packing space 10 as well as the neck portion 51 enveloped by the cover 4. As a result, the airtight sheath 100 efficiently provides multidimensional protection for the bottle 5 during package and delivery from being damaged by external impact.

It is understood that the invention may be embodied in other forms within the scope of the claims. Thus the present examples and embodiments are to be considered in all respects as illustrative, and not restrictive, of the invention defined by the claims.

What is claimed is:

1. An airtight sheath for packing a bottle, the airtight sheath made of at least two outer films heat-sealed together and comprising:

a first buffering unit comprising a plurality of first air columns, and two distal heat-sealing sides being heat-sealed to terminate two opposite sides of the first buffering unit;

a second buffering unit comprising a plurality of second air columns, two opposite sides of the second buffering unit being heat-sealed with the two distal heat-sealing sides of the first buffering unit;

a bottom unit comprising a plurality of bottom air columns connected with ends of the plurality of first air columns and second air columns, the bottom unit and the first and second buffering units cooperatively forming a packing space for packing the bottle therein; and a cover extending from one end of the first buffering unit opposite to the bottom unit and disposed within the packing space, the cover comprising two connecting air columns and at least a lid air column located between the two connecting air columns, each of the connecting air columns and the lid air column respectively having a top portion and a shielding portion bending from the top portion and extending downward to the packing space, the top portion extending and bending from the first air column, a side of each of the connecting air columns opposite to the lid air column being heat-sealed with the first buffering unit, whereby the cover and the first buffering unit cooperatively forming an insertion slot communicating with the packing space for buckling and enveloping a neck portion of the bottle.

2. The airtight sheath for packing a bottle of claim 1, wherein the first buffering unit is provided with multiple bending nodes formed on at least several of the first air columns corresponding in position to the shielding portions of the cover, and the bending nodes are arranged in parallel and in alignment with each other and heat-sealed to allow the first air columns to be bendable with respect to the bending nodes.

3. The airtight sheath for packing a bottle of claim 2, wherein the cover further comprises two protection units, which are heat-sealed to the connecting air columns in such a way that the connecting air columns and the lid air column are located between the two protection units, each of the protection units comprises a plurality of divided air columns and protection air columns extending in the packing space, the divided air columns extend and bend from the first air columns, each of the divided air columns has a width smaller than that of each of the first air columns, and an interval heat-sealing line is provided between and along either two of the adjacent divided air columns for facilitating bending of the divided air columns.

4. The airtight sheath for packing a bottle of claim 3, wherein two of the divided air columns are defined as a set, which is in alignment with a corresponding one of the first air columns.

5. The airtight sheath for packing a bottle of claim 1, wherein the bottom air columns of the bottom unit integrally extend and bend from the first air columns and the second air columns, and two recessed sealing lines respectively formed at and bending inwardly from opposite end portions of the bottom unit and connecting the distal heat-sealing sides of the first buffering unit so as to form two recessed portions between the bottom unit and the first and second buffering units.

6. The airtight sheath for packing a bottle of claim 5, wherein each of the bottom air columns has at least a sealing node being heat-sealed, the sealing nodes are arranged in alignment with each other, and the sealing nodes and the recessed sealing lines further enable the bottom air columns to bend toward the packing space when being inflated.

7. The airtight sheath for packing a bottle of claim 1, wherein the airtight sheath is capable of being connected with another airtight sheath in such a way that two adjacent distal heat-sealing sides of the two airtight sheaths are heat-sealed, where the two adjacent distal heat-sealing sides are further provided with a plurality of breakable sections formed thereon and spaced apart from each other, so that the two airtight sheaths are separable by tearing the breakable sections.

8. The airtight sheath for packing a bottle of claim 1, wherein the distal heat-sealing sides respectively extend upward to a location lower than the cover, whereby forming gaps between the distal heat-sealing sides and a top of the airtight sheath, so as to allow the first or second buffering units to be bendable with respect to the gaps.

9. The airtight sheath for packing a bottle of claim 1, wherein the second air columns of the second buffering unit extend upward to a height corresponding to the cover, and the two outer films extend upward of the second buffering unit to form an inflation path above the second air columns for enabling air to flow over the inflation path and inflate the airtight sheath.

10. An airtight sheath for packing a bottle, the airtight sheath made of at least two outer films heat-sealed together and comprising:

a first buffering unit comprising a plurality of first air columns, and two distal heat-sealing sides being heat-sealed to terminate two opposite sides of the first buffering unit;

a second buffering unit comprising a plurality of second air columns, two opposite sides of the second buffering unit being heat-sealed with the two distal heat-sealing sides of the first buffering unit;

a bottom unit comprising a plurality of bottom air columns connected with ends of the plurality of first air columns and second air columns, the bottom unit and the first and second buffering units cooperatively forming a packing space for packing the bottle therein, each of the bottom air columns having at least a sealing node being heat-sealed, the sealing nodes being arranged in alignment with each other, two recessed sealing lines respectively formed at and bending inwardly from opposite end portions of the bottom unit and connecting the distal heat-sealing sides, the sealing nodes and the recessed sealing lines cooperatively enabling the bottom air columns to bend toward the packing space when being inflated; and a cover extending from one end of the first buffering unit opposite to the bottom unit and disposed within the packing space, the cover and the first buffering unit cooperatively forming an insertion slot communicating with the packing space for buckling and enveloping a neck portion of the bottle.

* * * * *